US011060520B2

(12) United States Patent
Hibbard

(10) Patent No.: US 11,060,520 B2
(45) Date of Patent: Jul. 13, 2021

(54) POSITIVE DISPLACEMENT PUMP WITH PRESSURE RELIEF

(71) Applicant: Joe Dick Rector, Hemet, CA (US)

(72) Inventor: Richard Wallace Hibbard

(73) Assignee: Joe Dick Rector, Hemet, CA (US)

( * ) Notice: Subject to any disclaimer, the term of this patent is extended or adjusted under 35 U.S.C. 154(b) by 0 days.

(21) Appl. No.: 15/530,770

(22) Filed: Feb. 27, 2017

(65) Prior Publication Data

US 2018/0245585 A1 Aug. 30, 2018

Related U.S. Application Data

(63) Continuation-in-part of application No. 10/963,071, filed on Oct. 12, 2004, now Pat. No. 9,581,155.

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 2/00*** | (2006.01) |
| ***F04C 2/12*** | (2006.01) |
| ***F04C 2/08*** | (2006.01) |
| ***F04C 14/24*** | (2006.01) |
| *F04C 15/00* | (2006.01) |

(52) U.S. Cl.

CPC ..... *F04C 2/126* (2013.01); *F04C 2/084* (2013.01); *F04C 2/088* (2013.01); *F04C 14/24* (2013.01); *F04C 15/0057* (2013.01); *F04C 2240/30* (2013.01)

(58) Field of Classification Search

CPC ..... F04C 2/088; F04C 2/084; F04C 2/126; F04C 15/0042; F04C 15/0073; F04C 15/06; F04C 2240/30; F04C 15/0023; F04C 15/0026; F04C 15/0057

USPC ..... 418/206.1–206.8, 126, 189–190, 132

See application file for complete search history.

(56) References Cited

U.S. PATENT DOCUMENTS

| | | | | |
|---|---|---|---|---|
| 12,350 A * | 2/1855 | Holly | F04C 2/18 | 418/205 |
| 2,633,083 A * | 3/1953 | Smith | F04C 2/084 | 418/102 |
| 4,057,375 A | 11/1977 | Nachtrieb | | |
| 4,390,331 A * | 6/1983 | Nachtrieb | F04C 2/126 | 418/206.5 |

FOREIGN PATENT DOCUMENTS

| | | | | |
|---|---|---|---|---|
| JP | 56034994 A * | 4/1981 | F04C 2/126 | |

* cited by examiner

*Primary Examiner* — Theresa Trieu

(57) ABSTRACT

A rotary, self-priming, positive displacement pump is described. The pump may include a pump housing including an inlet and an outlet, a pump chamber including an upper wall, a lateral wall, and a floor, first and second rotary impellers in the pump chamber, and a pair of gears each secured to the first and second rotary impellers, and a pressure relief feature operable to relieve pressure developing in a relatively high pressure zone of the pump chamber. The gears mesh with each other to ensure that the vanes do not contact one another during rotation. The pressure relief feature may comprise one or more channels formed in the pump housing and/or the first and second rotary impellers. The channels connect the high pressure zone with another zone to redistribute pressure. The channels may include one continuous channel or alternatively, a plurality of unconnected channels.

13 Claims, 2 Drawing Sheets

POSITIVE DISPLACEMENT PUMP WITH PRESSURE RELIEF

REFERENCE TO RELATED APPLICATION

This application claims priority of U.S. patent application Ser. No. 10/963,071, filed Oct. 12, 2004, which is incorporated by reference in its entirety, and is related to my copending application entitled "Self-Priming Positive Displacement Pump With Sectioned Dividing Wall", filed concurrently with the present application.

FIELD OF THE DISCLOSURE

The present disclosure relates to pumps, and more particularly, to a positive displacement pump having rotary, intermeshing impellers.

BACKGROUND

Positive displacement pumps are more useful to pump liquids than other types of pumps, such as centrifugal pumps. A positive displacement pump may be more efficient, may have less variable output flow rates, and may provide still other advantages compared to other types of pumps. It is possible that due to pump chamber design, impeller design, clogs, and other influences, and combinations of these, high pressure may develop in localized zones, which high pressure interferes with successful pump operation.

There exists a need to relieve localized pressures in positive displacement pumps to assure successful operation.

SUMMARY

The disclosed concepts address the above stated situation by providing in exemplary embodiments a positive displacement pump wherein at least one pressure relief channel is provided. A pressure relief channel may communicate among all potential high pressure zones, or alternatively, may communicate between two such zones. In the latter case, a plurality of separate or discrete pressure relief channels may be provided. The pressure relief channels may be formed in a top wall of the pumping chamber, a lateral wall of the pumping chamber, or the floor of the pumping chamber, or in any combination of these.

The nature of the disclosed concepts will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

The Figures are exaggerated and schematic in that they may be distorted for clarity of the view, such as exaggerating clearances, omitting gear teeth, and are not necessarily shown to scale and proportion.

DETAILED DESCRIPTION

Figure 2:
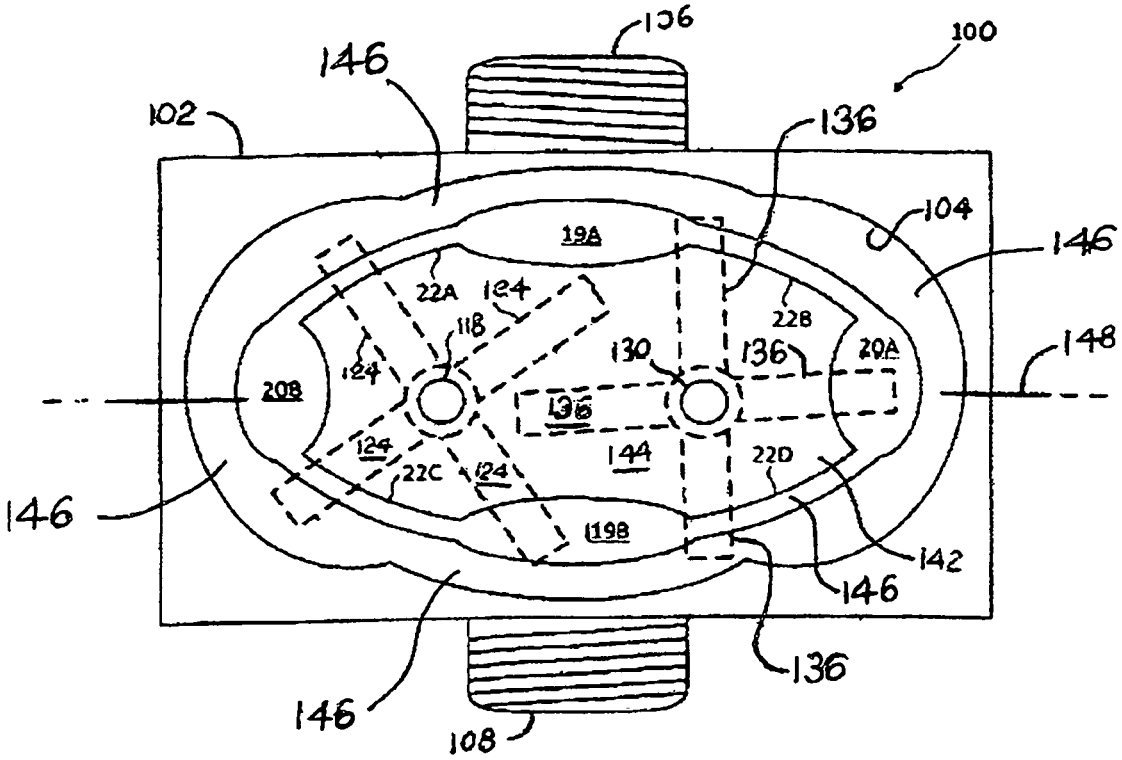
FIG. 2 is a schematic top plan view taken along line 2-2 of FIG. 1 of the inventive rotary, self-priming, positive displacement pump of FIG. 1, with impellers which would not be visible in this view indicated in broken lines, according to certain embodiments.
Figure 1:
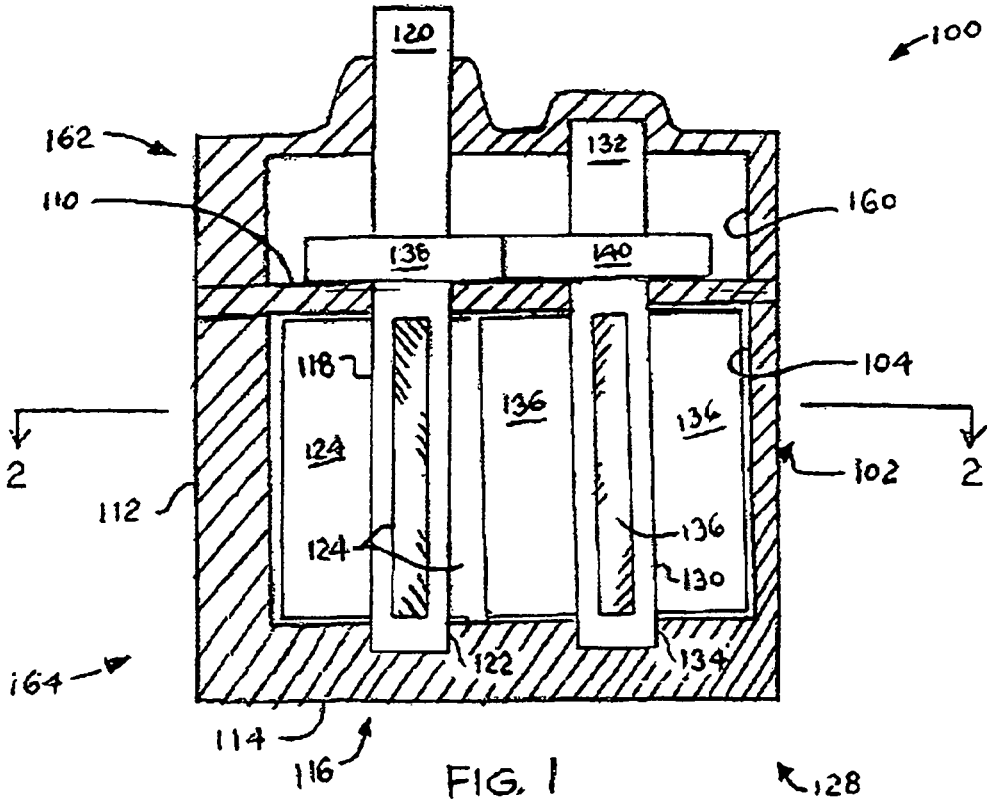
FIG. 1 is a schematic side view of the inventive rotary, self-priming, positive displacement pump, shown partially in cross section, in accordance with certain embodiments.

Referring to FIGS. 1 and 2, there is shown a rotary positive displacement pump 100 for pumping fluids. Rotary positive displacement pump 100 may comprise a pump housing 102 including a pump chamber 104 therein. Pump housing 102 may include including a fluid inlet 106 and a fluid outlet 108 communicating with pump chamber 104. Pump chamber 104 may include an upper wall 110, a lateral wall 112, and a floor 114. A first rotary impeller 116 is in pump housing 104, and may comprise a first shaft 118 including first shaft ends 120, 122 rotatably mounted in pump housing 102. First shaft 118 may including a plurality of vanes 124 having contoured faces 126 extending outwardly therefrom.

A second rotary impeller 128 is in pump housing 104, and comprises a second shaft 130 including second shaft ends 132, 134 rotatably mounted in pump housing 102. Second shaft 130 includes a plurality of vanes 136 having contoured faces 137 extending outwardly therefrom.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

It should be noted at this point that orientational terms such as upper refer to the subject drawing as viewed by an observer. The drawing figures depict their subject matter in orientations of normal use, which could obviously change. Therefore, orientational terms must be understood to provide semantic basis for purposes of description only, and do not imply that their subject matter can be used only in one position or orientation.

A pair of gears 138, 140 may each be secured to one of first shaft 118 and second shaft 130 of first and second rotary impellers 116, 128. Gears 138, 140 mesh with each other and synchronize rotation of first rotary impeller 116 and second rotary impeller 128 to ensure that vanes 124, 136 do not contact one another during rotation.

Pump 100 may further comprise a gear chamber 160 enclosing the pair of gears 138, 140, and a dividing wall (seen as upper wall 110 in the embodiment of FIG. 1) separating gear chamber 160 from pump chamber 104. Under ordinary conditions, gear chamber 160 is dry or free of the fluid being pumped, while pump chamber 104 would be wet from containing the fluid being pumped.

In an embodiment, pump housing 102 comprises three major parts or components, including a first part enclosing gear chamber 160, dividing wall or pump chamber upper wall 110, and a third part enclosing pumping chamber 104. The first part may be called a gear chamber cover 162. The third part may be called a pump chamber cover 164.

In an embodiment, each of the first part (gear chamber cover 162), the second part (dividing wall 110), and the third part (pump chamber cover 164) has a surface exposed to the exterior of pump housing 102 when the first part, the second part, and the third part are assembled together. It would be possible to form dividing wall 110 as fully internal or partially internal to pump housing 102 (this option is not shown).

A pressure relief feature is operable to relieve pressure developing in a relatively high pressure zone of pump chamber 104. A high pressure zone is indicated representatively at 142. A relatively low pressure zone is indicated representatively at 144.

The pressure relief feature comprises at least one channel in at least one of pump housing 102, first rotary impeller 116, and second rotary impeller 128. The at least one channel communicates between at least two pressure zones of pump chamber 104, the pressure zones including a relatively high pressure zone 142 and a relatively low pressure zone 144. A channel may be a groove or recess formed in a wall of pump housing 102 facing first and second rotary impellers 116, 128. This creates a relatively large gap through which the fluid being pumped may flow, thereby reducing pressure in high pressure zone 142.

As seen in FIG. 2, at least one channel extends in a closed loop 146 around and proximate a periphery of pump chamber 104.

Still referring to FIG. 2, at least one channel may comprise at least one enlarged area and at least one constricted area. In FIG. 2, there are four enlarged areas 19A, 19B, 20A, 20B, and four constricted areas 22A, 22B, 22C, and 22D. At least one said enlarged area 19A may be proximate fluid inlet 106. At least one said enlarged area 19B may be proximate fluid outlet 108. At least one said enlarged area 20A may be at one end of pump chamber 104 along a longitudinal axis 148 of pump chamber 104. A second said enlarged area 20B may be at an opposed end of pump chamber 104 along longitudinal axis 148 of pump chamber 104.

Figure 3:
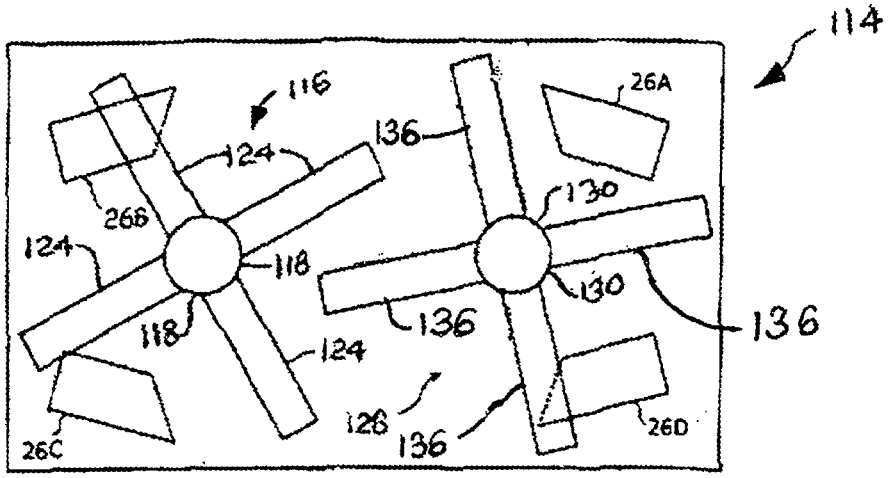
FIG. 3 is a schematic top plan view taken along line 2-2 of FIG. 1, according to certain embodiments.

Referring now to FIG. 3, the at least one channel may comprise a plurality of unconnected channels 26A, 26B, 26C, 26D. In FIG. 3, channels 26A, 26B, 26C, 26D are strategically located to assure that fluid can flow from a high pressure zone 142 under beneath a vane 124 to a relatively low pressure zone 144 (e.g., as shown in FIG. 2).

Figure 4:
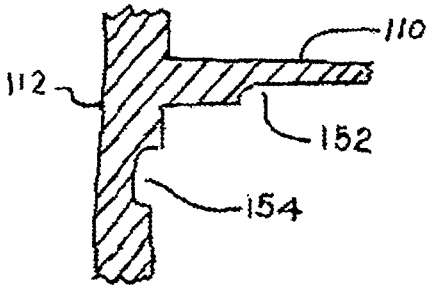
FIG. 4 is a cross sectional detail view of the upper left of FIG. 1, according to certain embodiments.

Referring to FIG. 4, in an embodiment, one unconnected channel 152 is at least partially in the upper wall 110 of pump chamber 104. In an embodiment, one unconnected channel 154 is at least partially in lateral wall 112 of pump chamber 104.

Figure 5:
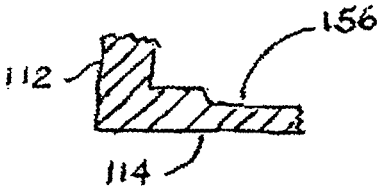
FIG. 5 is a cross sectional detail view of the lower left of FIG. 1, according to certain embodiments.

As seen in FIG. 5, in an embodiment, one unconnected channel 156 is at least partially in floor 114 of pump chamber 104.

Figure 6:
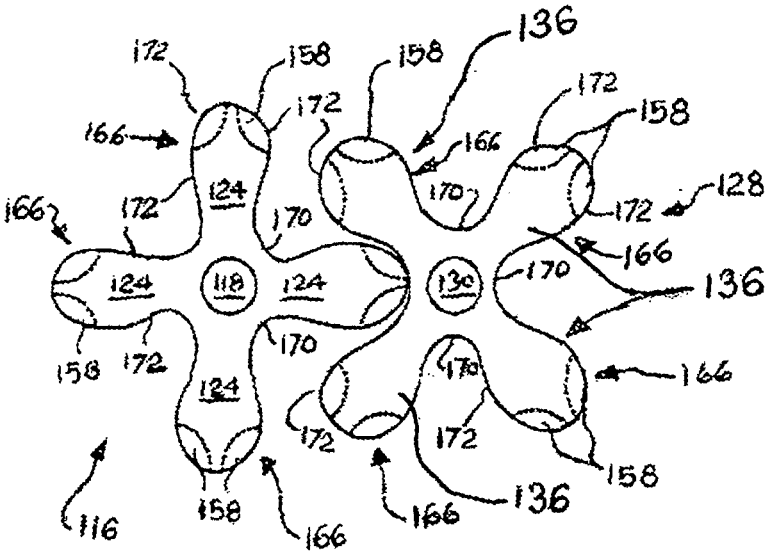
FIG. 6 is a top plan detail view of impellers according to certain embodiments.

Turning now to FIG. 6, each vane 124 may have a complementary cut-out slot 158 for clearance during rotation of first and second rotary impellers 116, 128 during synchronous intermeshing of vanes 124. Vanes 124 of first rotary impeller 116 and second rotary impeller 128 may comprise enlarged heads 166 including curved lateral surfaces and curved ends 172. First rotary impeller 116 and second rotary impeller 128 may comprise junctures 170 of adjacent vanes 124, junctures 170 curved to cooperate with enlarged heads 166 of vanes 124. Curved lateral surfaces and ends 172 enable close tolerances between adjacent vanes 124 during rotation of first and second rotary impellers 116, 128 to occur for a greater degree of rotation than would occur with the uncurved vanes 124 of FIG. 3 for example.

In the preceding description, numerous specific details are set forth in order to provide an understanding of the present invention. It will be apparent, however, to one skilled in the art that the present invention may be practiced without these specific details. The specific details may be varied from and still be contemplated to be within the spirit and scope of the present disclosure. Many modifications of examples set forth herein will come to mind to one skilled in the art to which the present disclosure pertains having the benefit of the teachings presented in the foregoing descriptions and the associated drawings.

This written description uses examples of the subject matter disclosed to enable any person skilled in the art to practice the same, including making and using any devices or systems and performing any incorporated methods. The patentable scope of the subject matter is defined by the claims, and can include other examples that occur to those skilled in the art. Such other examples are intended to be within the scope of the claims.

The above-described embodiments are intended to be illustrative in all respects, rather than restrictive, of the embodiments. Thus, the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items. Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A rotary positive displacement pump for pumping fluids, comprising:

a pump housing including a pump chamber therein, the pump housing including a fluid inlet and a fluid outlet communicating with the pump housing, the pump chamber having an upper wall, a lateral wall, and a floor;

a first rotary impeller in the pump housing, the first rotary impeller comprising a first shaft including first shaft ends rotatably mounted in the pump housing, the first shaft including a plurality of vanes having contoured faces extending outwardly therefrom;

a second rotary impeller in the pump housing, the second rotary impeller comprising a second shaft including second shaft ends rotatably mounted in the pump housing, the second shaft including a plurality of vanes having contoured faces extending outwardly therefrom;

a pair of gears each secured to one of the first shaft and the second shaft of the first and second rotary impellers, wherein the gears mesh with each other and synchronize rotation of the first rotary impeller and the second rotary impeller to ensure that the vanes do not contact one another during rotation; and a pressure relief feature operable to relieve pressure developing in a relatively high pressure zone of the pump chamber wherein the pressure relief feature comprises at least one channel in at least one of the pump housing, the first rotary impeller, and the second rotary impeller, wherein the at least one channel communicates between at least two pressure zones of the pump chamber, wherein the at least one channel extends in a closed loop around and proximate a periphery of the pump chamber, the at least one channel comprises at least one enlarged area and at least one constricted area, and at least one said enlarged area is at one end of the pump chamber along a longitudinal axis of the pump chamber.

2. The rotary positive displacement pump of claim 1, wherein at least one said enlarged area is proximate the fluid inlet.

3. The rotary positive displacement pump of claim 1, wherein at least one said enlarged area is proximate the fluid outlet.

4. The rotary positive displacement pump of claim 1, wherein a second said enlarged area is at an opposed end of the pump chamber along the longitudinal axis of the pump chamber.

5. The rotary positive displacement pump of claim 1, wherein the at least one channel comprises a plurality of unconnected channels.

6. The rotary positive displacement pump of claim 5, wherein one said unconnected channel is at least partially in the upper wall of the pump chamber.

7. The rotary positive displacement pump of claim 5, wherein one said unconnected channel is at least partially in the lateral wall of the pump chamber.

8. The rotary positive displacement pump of claim 5, wherein one said unconnected channel is at least partially in the floor of the pump chamber.

9. The rotary positive displacement pump of claim 1, wherein each said vane has a complementary cut-out slot for clearance during rotation of the impellers during synchronous intermeshing of the vanes.

10. The rotary positive displacement pump of claim 1, further comprising a gear chamber enclosing the pair of gears, and a dividing wall separating the gear chamber from the pump chamber.

11. The rotary positive displacement pump of claim 10, wherein the pump housing comprises three major parts including a first part enclosing the gear chamber, a second part enclosing the dividing wall, and a third part enclosing the pumping chamber.

12. The rotary positive displacement pump of claim 11, wherein each of the first part, the second part, and the third part has a surface exposed to the exterior of the pump housing when the first part, the second part, and the third part are assembled together.

13. The rotary positive displacement pump of claim 1, wherein the vanes of the first rotary impeller and the second rotary impeller comprise enlarged heads including curved lateral surfaces, and the first rotary impeller and the second rotary impeller comprise junctures of adjacent said vanes curved to cooperate with the enlarged heads of the vanes.

* * * * *